US005328430A

United States Patent [19]

Vittone et al.

[11] Patent Number: 5,328,430

[45] Date of Patent: Jul. 12, 1994

[54] MULTIPLE STATION WEIGHT SYSTEM

[76] Inventors: Larry W. Vittone; Suzanne R. Vittone, both of Rte. 2, Box 23, Ollis Rd., Oliver Springs, Tenn. 37840

[21] Appl. No.: 950,186

[22] Filed: Sep. 24, 1992

[51] Int. Cl.[5] ..... A63B 21/062

[52] U.S. Cl. ..... 482/102; 482/138; 482/99; 482/98

[58] Field of Search ..... 482/98, 99, 100, 101, 482/102, 103, 104, 138

[56] References Cited

U.S. PATENT DOCUMENTS

| | | | |
|---|---|---|---|
| 931,699 | 8/1909 | Medart . | |
| 2,977,120 | 3/1961 | Morris . | |
| 3,072,400 | 1/1963 | Dykinga . | |
| 3,840,227 | 10/1974 | Chesemore . | |
| 3,850,431 | 11/1974 | Winans . | |
| 4,199,139 | 4/1980 | Mahnke et al. . | |
| 4,456,246 | 6/1984 | Szabo | 482/99 |
| 4,632,388 | 12/1986 | Schleffendorf . | |
| 4,697,809 | 10/1987 | Rockwell | 482/138 |
| 4,744,559 | 5/1988 | Mahnke et al. | 482/99 |
| 4,809,972 | 3/1989 | Rasmussen et al. | 482/138 |

*Primary Examiner*—Richard J. Apley
*Assistant Examiner*—Lynne A. Reichard
*Attorney, Agent, or Firm*—Luedeka, Neely & Graham

[57] ABSTRACT

The specification discloses an exercise machine which provides for the use of a single set of weights from multiple stations. In a preferred embodiment, a set of weights is lifted by independent cable systems each including a lifter guidably supported on a frame for liftably engaging the weight independent of the other lifters in response to application of a force on the cable by the user.

13 Claims, 6 Drawing Sheets

MULTIPLE STATION WEIGHT SYSTEM

This invention relates generally to physical conditioning devices. More particularly, the invention relates to an exercise machine having a set of weights usable from multiple exercise stations.

One type of exercise equipment available for the development of human muscles uses weights suspended by cables with the cables passing over one or more pulleys. A handle connected to the free end of the cable allows a user to raise and lower the suspended weights and thus perform a number of exercises from various positions; e.g. leg lifts, bench presses, lat pulls and curls. The weights are usually centrally located in the machine and the exercises are performed from outboard positions located around the weight stations in a carousel-type arrangement.

One such exercise machine is the so called "universal gym" which contains several weight/pulley stations within a single frame. Typically, each station is dedicated to a particular type of exercise and includes a set of weights.

Universal gym-type exercise machines are popular in part because they offer the user a wide range of exercises and may be accommodated in a smaller space than a plurality of individual machines. However, universal gym machines suffer from the disadvantage that they require multiple sets of weights, each dedicated to use with a single station, which adds significantly to the size, weight, and cost of the machine. It is therefore desirable to provide a machine which enables the use of the same set of weights from multiple exercise stations in order to reduce the size, weight and cost of the machine.

Accordingly, it is an object of the invention to provide an improved exercise machine.

It is another object of the invention to provide an exercise machine of the type which uses weights and pulleys.

A further object of the invention is to provide an exercise machine of the character described which enables the use of the same set of weights from multiple exercise stations.

Still another object of the invention is to provide an exercise machine of the character described which is of reduced size, weight, and cost as compared to conventional exercise machines.

Yet another object of the present invention is to provide an exercise machine of the character described which is uncomplicated in configuration and simple to use.

Having regard to the above and other objects, the present invention is directed to an exercise machine which comprises a frame, a force resistor connected to the frame including a weight resistably movable along a path in response to application of a force thereto, a first user-applied force transmitter connected to the frame for enabling a user to engage and apply a first force to the force resistor to provide resisted movement of the weight along the path, and a second user-applied force transmitter connected to the frame for enabling a user to engage and apply a second force to the resistor to provide resisted movement of the weight along the path, wherein the first and second user-applied force transmitters are independently selectably engagable with the resistor so that either may be employed by the user to engage and apply a force to move the weight along the path with the other of the first or second user-applied force means remaining substantially at rest and disengaged from the resistor.

In a preferred embodiment, an exercise machine according to the invention comprises a weight mounted for movement along a support and a plurality of lifters mounted for movement independent of one another along guides disposed adjacent the support, each of the lifters including means for liftably engaging the weight to move the weight along the support independently of the other lifter so that each lifter may be employed independently of the other to lift and move the weight along the support.

According to one aspect of the invention, the exercise machine includes a plurality of cable systems for enabling pulls or exercises on the same set of weights from a plurality of exercise stations whereby pulling with one cable does not disturb the other cable. Each cable system includes a lifter at one end supported beneath the weight, a handle or pull at the other end and a cable supported on one or more pulleys extending between the lifter and the handle. When a handle of one cable system is pulled a lifting force is exerted on the weight through its associated lifter. The other cable systems are substantially unaffected, and remain substantially at rest. This enables independent use of the weight from several exercise stations without a complicated pulley network or switching mechanism.

The above and other features and advantages of the invention will be described in further detail in the following specification with reference to the accompanying drawings in which:

FIG. 1(*a*) is a perspective view of a preferred embodiment of an exercise machine in accordance with the invention and FIG. 1(*b*) is a fragmentary close-up view of a portion of the machine of FIG. 1(*a*) showing movement of a weight;

FIGS. 2(*a*) and 2(*b*) are further fragmentary close-up views of the machine of FIG. 1(*a*);

Figure 1A:
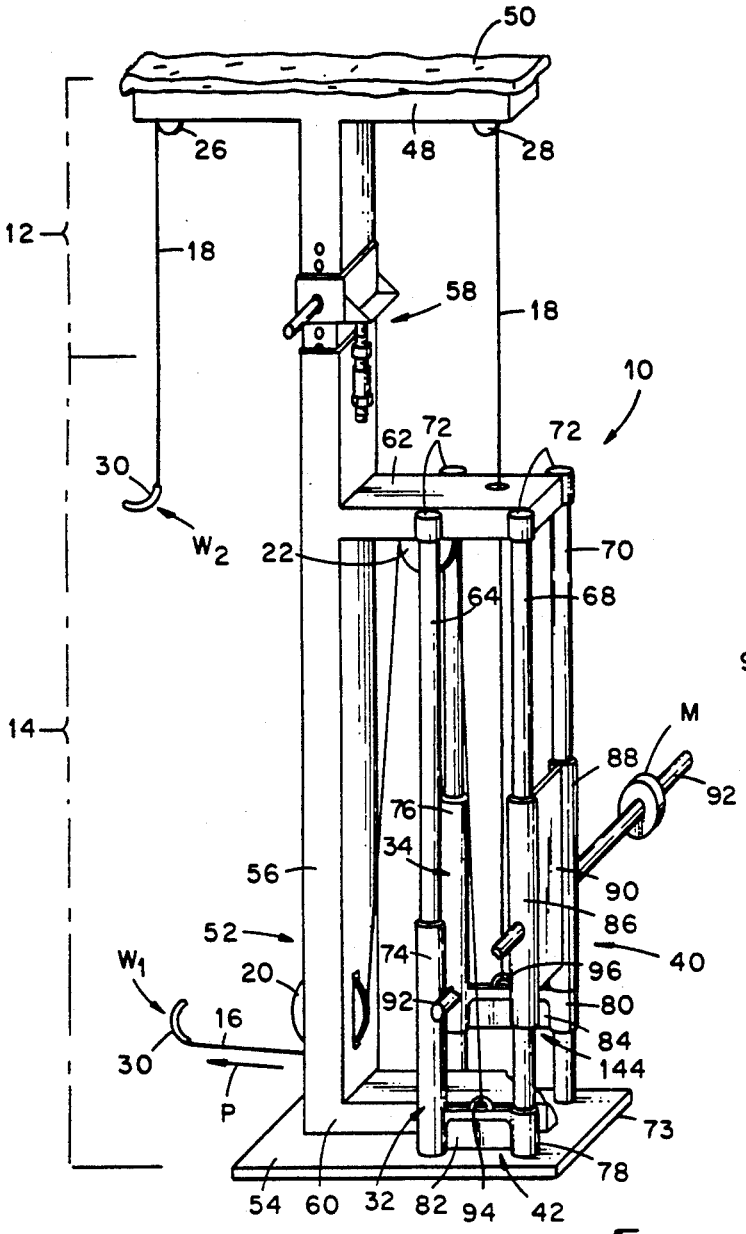
Figure 1B:
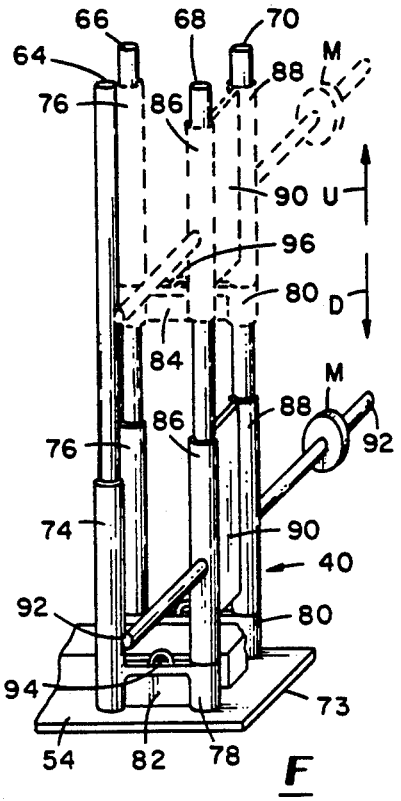

With reference now to the drawings in which like reference characters designate like or similar parts throughout the several views, there is shown in FIG. 1 an exercise machine 10 containing features of the present invention which enables the use of the same set of weights from multiple exercise or work stations. The machine 10 includes an upper frame assembly 12 telescopically connected to a lower frame assembly 14. A pair of cables 16 and 18 are trained over a series of pulleys 20, 22, and 26, 28, respectively, which are mounted on the frame assemblies. The cable 16 is associated with a first workstation W1 designated for one type of exercise and cable 18 is associated with a second workstation W2 designated for another type of exercise.

One end of each cable 16 and 18 connects to a handle 30 configured for grasping by the hand of a user. The handle 30 may take a variety of different forms depending on the type of exercise involved. For example, the handle 30 may be provided by an elongate bar with grips at its opposite ends and connected at the middle to the cable; i.e., a "lat" bar as it is sometimes referred to in the trade. Or, the handle 30 may be provided by one or more grips connected directly to the cable or grips which include a ball joint, such as is described in U.S. patent application Ser. No. 07/738,251 entitled "Handle for Exercise Machine" and incorporated herein by reference.

The other end of each cable 16 and 18 connects to a lifter 32 and 34, respectively, for transmitting force supplied by the user through the cables to a weight carrier 40 having weights M supported thereon. Each lifter 32 and 34 includes structure for liftably engaging the weight carrier 40 to lift the weights in along a generally vertical path such that the other lifter may remain substantially at rest. In a preferred embodiment, this structure is provided by feet 42 and 44 on the lifters 32 and 34, respectively, each foot 42, 44 projecting to a position below the carrier 40 with the carrier 40 resting thereon when both lifters are inactive.

During exercise at workstation W1, the user pulls the cable 16 in such a manner as to exert an upward force on the lifter 32 and thereby lift the carrier 40 and the weights M. During exercise at workstation W2, the user pulls the cable 18 in such a manner as to exert a similar upward force on lifter 34 and thereby lift the carrier 40 and weights M.

Figure 2A:
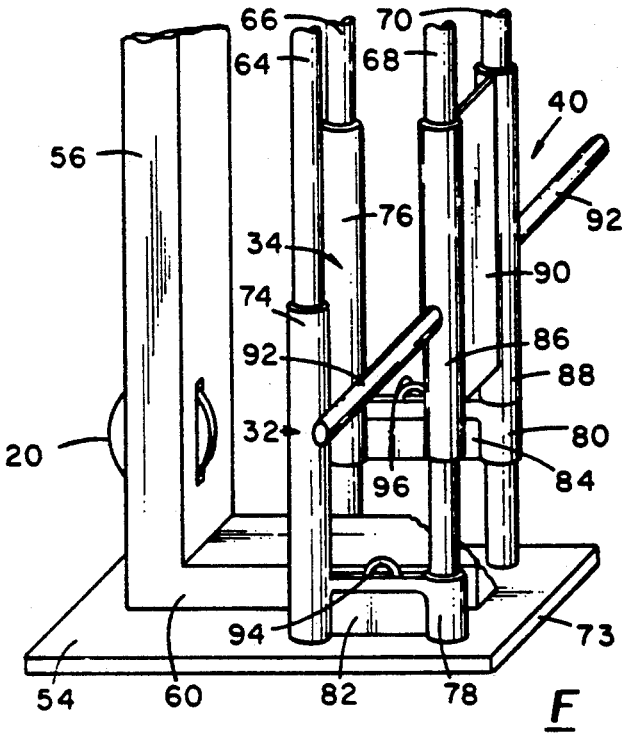
Figure 2B:
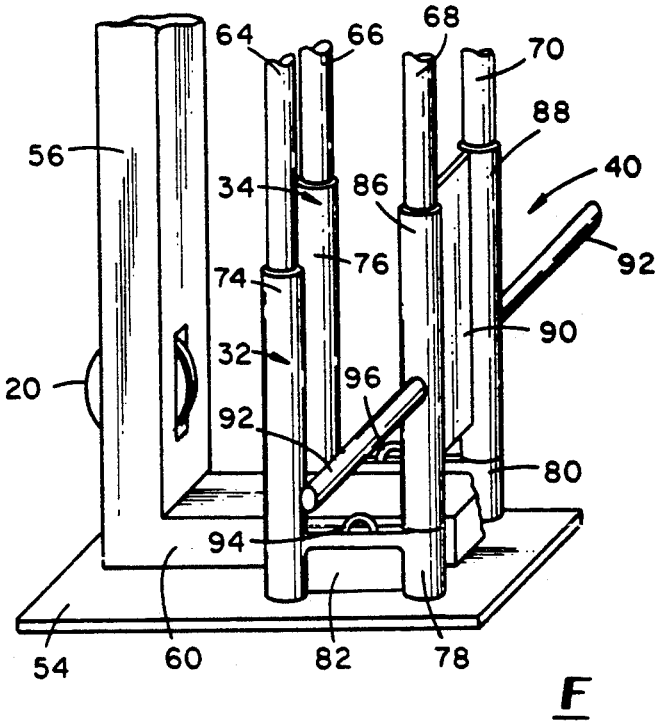
Figure 3:
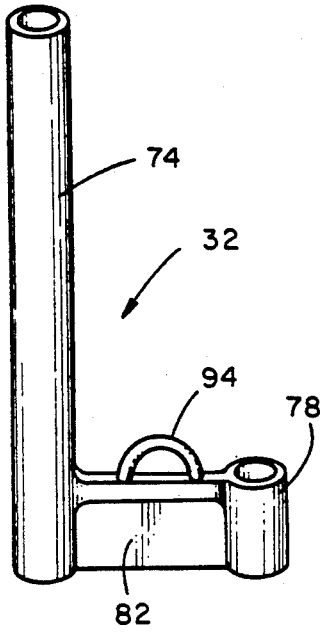
FIG. 3 is a close-up view of a preferred embodiment of a lifter for use in the present invention.
Figure 4:
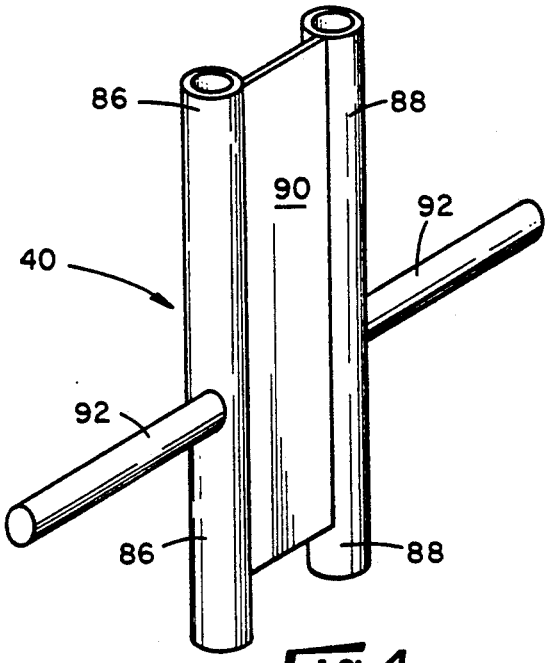
FIG. 4 is a close-up view of a weight carrier for use in the present invention.

It is a feature of the invention that each lifter 32, 34 may be used to lift the carrier and weights independently of the other wherein exertion of a force through lifter 34, for example, to lift the carrier 40 and weights M lifts the carrier off of the lifter 32 which remains substantially at rest. This is shown in FIG. 1 and FIG. 2(*a*) where the lifter 34 is in a raised position supporting the carrier 40 a distance above the top of the other lifter 32, such as when a force is supplied by the user to pull the cable 18 during exercise at work station W2. Under such conditions the lifter 32 remains at rest and its associated cable 16 is unaffected, it being understood that each cable and lifter moves independently of the another so that the lifter, pulleys, and cable associated with work station W1 are at rest and when the user is pulling only on the cable 18 associated with work station W2, and vice versa. FIG. 2(*b*) depicts the lifters 32 and 34 at rest such as when the user is not exercising at either of the available work stations.

While the apparatus is shown as having only two work stations, it will be understood that additional sets of lifters and associated cable systems; i.e. work stations, may be provided and that each lifter may be made to move only in response to its respective cable so that each lifter and cable system is independent of the other. In this manner, the apparatus enables the use of the same set of weights from multiple work stations.

With continued reference to FIG. 1(*a*), the upper frame assembly 12 includes a generally T-shaped member constructed from a vertical frame member 46 connected, such as by welding, to a horizontal cross-piece 48. The vertical frame member 46 preferably is provided by a hollow square tube which is telescopically positionable within a correspondingly square but slightly larger opening at the top of the lower frame assembly. The cross-piece 48 of the upper frame assembly 12 contains a bumper 50 along its upper surface such as a rubberized material having a high coefficient of friction which is adapted to frictionally engage the ceiling of a room.

The lower frame assembly 14 includes an L-shaped member 52 fixedly mounted as by welding to a rectangular support plate 54 which rests on a support surface, such as floor F. Like the frame member 46 of the upper frame assembly 12, a vertical part 56 of the L-shaped member 52 of the lower frame assembly 12 is preferably provided by a hollow square tube, the top opening of which is dimensioned to fittingly receive the lower end of the member 46 therein for telescopic movement of the upper frame assembly in the member 52. An adjustment assembly 58 described in more detail hereinafter adjustably supports the upper assembly 12 in a desired position on the lower assembly 14.

A horizontal part 60 of the L-shaped member 52 extends generally along the upper surface of support plate 54 oriented generally parallel to the major axis of the plate about midway between its side edges. A support arm 62 extends out from the vertical part 56 of the member 52 in a generally horizontally attitude in general vertical registry with the horizontal part 60 of member 52, and from a location adjacent the upper end of the vertical part 56 of member 52 spaced above the horizontal part 60 a sufficient distance to accommodate vertical movement of the carrier 40 during exercise.

Spaced pairs of substantially parallel upstanding support rods 64, 66 and 68, 70 are secured between arms 62 and plate 54 to support the lifters 32, 34 and the carrier 40 for vertical movement. Rod pair 64, 66 is located adjacent the vertical part 56 of member 52 and its rods are spaced apart on opposite sides of the horizontal part 60 of member 52 at their lower ends where they are fixedly secured to plate 54 as by welding, and are secured at their upper ends as by welding to side mounts 72 projecting laterally from opposite sides of the arm 62. Rod pair 68, 70 is located outboard of rod pair 64, 66 on arm 62, so as to extend vertically between positions adjacent the outer end of arm 62 and positions adjacent an end edge 73 of plate 54. The upper ends of the rods in rod pair 68, 70 are secured to arm 62 as by welding to side mounts 72 and the lower ends are secured to plate 54 adjacent the sides of horizontal part 60 of member 52 similar to the rod pair 64, 66.

Each lifter 32, 34 includes an elongate upstanding tubular sleeve 74, 76 having an internal diameter of about but slightly greater than that of rods 62, 64 and within which rods 62, 64 are received to support the sleeves 74, 76 of lifters 32, 34 for vertical movement along the rods of rod pair 62, 64. The feet 42, 44 of each lifter 32, 34 project perpendicularly from adjacent the lower ends of the sleeves 74, 76 and include collars 78, 80 on their outboard ends and webs 82, 84 extending therebetween. Collars 78, 80 each define a vertically aligned through opening dimensioned to receive one of the rods of rod pair 68, 70 therethrough to support the collars 78, 80 of lifters 32, 34 for vertical movement along rods 68, 70. Each collar 78, 80 is spaced from its associated sleeve 74, 76 by the webs 82, 84 in conformity with the spacing between the rod pairs 64, 66 and 68, 70.

The weight carrier 40 includes vertically oriented sleeves 86 and 88 extending along opposite marginal side edges of a rectangular web 90. The sleeves 86, 88 are spaced apart in accordance with the distance of separation between the rods of rod pair 68, 70 and include elongate openings which receive rods 68 and 70 therethrough so that the carrier 40 is vertically movable on rod pair 68, 70 with web 90 spanning therebetween.

Generally horizontal weight-supporting bars 92 project laterally from the sleeves 86 and 88 in generally opposite directions substantially in the plane of the plate 90 about midway along the length of the sleeves. The bars 92 support the weights M on the carrier 40 as shown, such weights M including, but not limited to, conventional disc-shaped weights; and the bars 92 preferably include provision for holding the weights M thereon against accidental spillage.

It will therefore be seen that the lifters 32, 34 are supported between rods 64 and 68 and between rods 66 and 70 of rod pairs 64, 66 and 68, 70 for vertical movement on frame assembly 14 while carrier 40 is supported entirely between the rods of rod pair 68, 70. The feet 42, 44 of lifters 32, 34 are disposed with their respective collars 78, 80 beneath the sleeves 86, 88 of carrier 40 on rod pair 68, 70. This arrangement provides for independent use of either of the lifters 32, 34 for lifting the carrier 40 and weights M without distributing the other lifter.

It is noted that the lower ends of the rod pairs 64, 66 and 68, 70 are spaced sufficiently from the horizontal part 60 of L-shaped member 52 to accommodate the width of sleeves 74, 76 and collars 78, 80 between the rods and the horizontal part with the sleeves and collars resting substantially on the plate 54. The side mounts 72 space the upper ends of rod pairs 64, 66 and 68, 70 from arm 62 sufficient to provide the substantial parallel relation and vertical disposition of the rods.

The cables 16 and 18 may be connected to the lifters 32 and 34 as by loops 94 and 96 projecting from the top of webs 82 and 84, respectively. The ends of the cables 16 and 18 may be tied or welded to the loops 94 and 96 or they may be removably coupled thereto as by a type of safety hook common in equipment of this type.

It is to be noted that in order to cause one of the lifters 32, 34 to remain at rest while the other is raised to lift the carrier 40, it may be necessary to provide for retention of the unused lifter adjacent the plate 54 while the other is raised. Otherwise, the weight of any handle 30 may tend to cause an unused lifter and its associated handle and cable to remain against the bottom of the carrier and follow the carrier up and down in a "ghost" movement. To eliminate this ghost movement of an unused lifter, the weight of each lifter 32, 34 is preferably sufficient to cause an unused lifter to remain down against the plate 54 by the force of gravity when the other lifter is raised to lift the carrier 40 from the unused lifter. Alternatively, means in the nature of a threshold resistance against initial upward movement of the lifters, 32, 34 may be provided such as a cam, latch or yielding protuberance which provides a small force impeding upward movement, easily overcome by the user who pulls on the handle 30, but not easily overcome by the mere weight of the handle. Any such feature would not significantly impede lowering of the lifter to its normal resting position and would therefore be an essentially one-way impedance, substantially resisting only upward movement.

Figure 5:
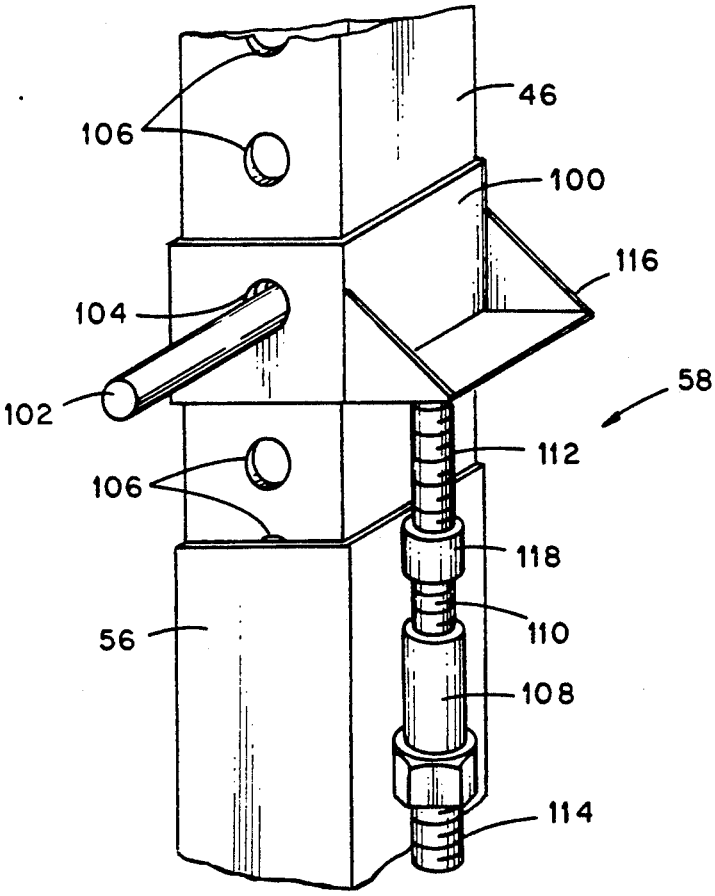
FIG. 5 is a fragmentary close-up view of a telescoping vertical support for use in the machine of FIG. 1(*a*)

As a further feature, the adjustment assembly 58 enables the machine 10 to be easily set-up or taken down so as to allow the machine to be portable. With reference to FIG. 5, the adjustment assembly allows the exercise machine to be erected and held in place between opposed surfaces, such as between the floor and the ceiling.

In a preferred embodiment, the assembly 58 includes a collar 100 which is couplable with frame member 46 of the upper frame assembly 12 as by pin 102 passing through an opening 104 in the collar and one of a plurality of spaced-apart vertically aligned openings 106 in the member. An upwardly oriented elongate nut 108 is attached to the outer surface of the upper end of frame member 56 of the lower frame assembly 14 as by welding. An elongate screw adjuster 110 is threadably received through nut 108 so that its upper and lower parts 112 and 114 project above and below the nut. The end of upper part 112 of adjuster 110 is engagable upon the lower surface of boss 116 projecting from the side of collar 100, and a band 118 on the upper part 112 limits downward movement of the adjuster by engagement with nut 108 when an attempt is made to unscrew the adjuster from the nut beyond a predetermined amount.

To set up the machine 10, the upper frame assembly 12 is telescopically adjusted relative to the lower frame assembly 14 such that the upper support abuts the ceiling. Collar 100 is then positioned with its opening 104 aligned with an opening 106 in frame member 46 adjacent the upper end of frame member 56, and pin 102 is placed through the openings. The adjuster 110 is then advanced to cause the end of the upper part 112 to engage boss 116 so that the entire machine 10 is expanded vertically between the floor and the ceiling into compression to tightly hold the machine in place.

To relocate the machine 10, the upper frame assembly 12 is telescopically adjusted to relieve pressure between the floor and the ceiling. The upper frame assembly 12 may also be separated from the lower frame assembly 14 to facilitate transportation of the machine 10 to a new location. The machine 10 may then be installed in the manner discussed above at the new location. Thus, it will be appreciated that the exercise machine of the present invention may be easily set up or taken down and may be reduced in size for ease of transportation.

Once set up, the machine 10 is ready for use. To use the machine 10, the user places the desired amount of weights on the bars 92, and positions himself at the desired work station. The user then grasps the handle of the cable located at the desired work station W1 or W2 and pulls or otherwise exerts a force on the handle to raise the slide and, hence, the carrier and the weights. For example, in the embodiment shown in FIG. 1(*a*), the user may position himself in a seated orientation on the floor in front of work station W1 and pull on the handle 30 associated with the cable 16 in a generally horizontal direction such as in the performance of a rowing type exercise. When the user pulls on the handle associated with the cable 16, the cable is pulled over the pulleys 20, 22 and transfers a force shown by the arrow P to the lifter 32. This force P, if sufficient to overcome the combined weight of the lifter 32, the carrier 40, the cable resistance and the weights M mounted on the carrier, will cause the lifter 32 to rise upwardly on rods 64 and 68 of rod pairs 64, 66 and 68, 70 bearing against the bottom of the carrier 40 to lift the carrier 40 and supported weights M vertically along the rods. In this manner the carrier 40 and weights M may be raised and lowered along a path indicated by the arrows U and D shown in FIG. 1(*b*) in response to the force exerted by the user to accomplish the desired resistance exercise. The user may then relocate to workstation W2 and exercise by exerting force on the cable 18 to similarly raise the lifter 34 and lift the carrier and weights. The depicted apparatus therefore will be understood to provide multiple work stations which utilize the same set of weights. Each work station operates independently of the other work stations, but may also be utilized in conjunction with one another to accomplish a variety of exercises. For example, a user may desire to pull on cable 16 and cable 18 at the same time. To this end, it will be appreciated that the user is not limited to a particular work station and may chose to perform on more than one at a time if desired.

Figure 6:
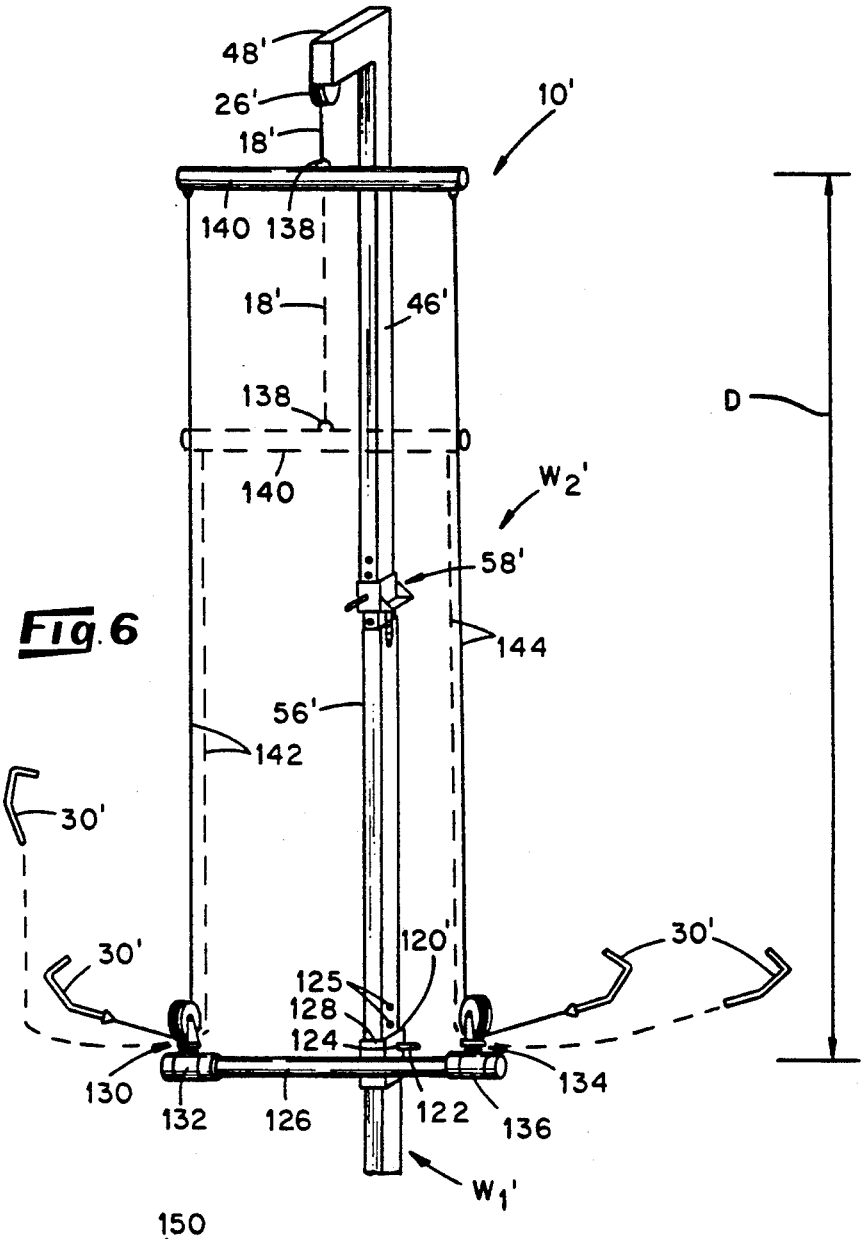
FIG. 6 is a fragmentary view of a workstation including double cables and ball joint pulleys mounted on rotating collars in accordance with another embodiment of the present invention.

With reference now to FIG. 6, there are shown relevant portions of an alternate embodiment of the present invention which uses a double cable arrangement together with ball joint pulleys mounted on rotating collars. Elements corresponding to elements of the embodiment 10 previously described will be referenced with the same characters using a prime suffix.

The embodiment 10' of FIG. 6 includes a collar 120 which is couplable with frame member 56' of the lower frame assembly 14' as by a pin 122 passing through an opening 124 in the collar 120 and one of a plurality of spaced-apart vertically aligned openings 125 in the member 56' so that the collar may be positioned as desired, and may be re-positioned for use with workstation W1'.

A rod 126 having a length of between about 1 to 3 feet attaches at its midpoint, as by welding, to an outer surface 128 of the collar 120 so that the rod 126 is perpendicular to the length of the member 56'. A ball joint pulley 130 rotatably mounted on a collar 132, shown in detail in FIG. 7 and explained more fully below, is mounted on the left-hand end of the rod 126. Likewise, a ball joint pulley 134 rotatably mounted on a collar 136 is mounted on the right-hand end of the rod 126.

With continued reference to FIG. 6, the end of a main cable 18' of workstation W2' attaches to a rigid loop 138 provided at the midpoint of a rod 140 so that at rest the rod 140 is supported by the cable 18' just below the pulley 26'. The rod 140 preferably has dimensions substantially equal to those of the rod 126.

An alternate cable 142 attaches, such as by welding, to the left-hand end of the bar 140. Likewise, an alternate cable 144 attaches to the right-hand end of the bar 140. The lower end of each cable 142, 144 passes through the pulleys 130, 134, respectively, and attaches to a handle 30'. In this embodiment, the handles 30' are preferably provided by handles such as those described in U.S. patent application Ser. No. 07/738,251, the disclosure of which is incorporated herein by reference. Each cable 142, 144 preferably has a length slightly greater than the distance D between the bar 140 and the rod 126 so that the handles do not bump against the pulleys when released.

Figure 7:
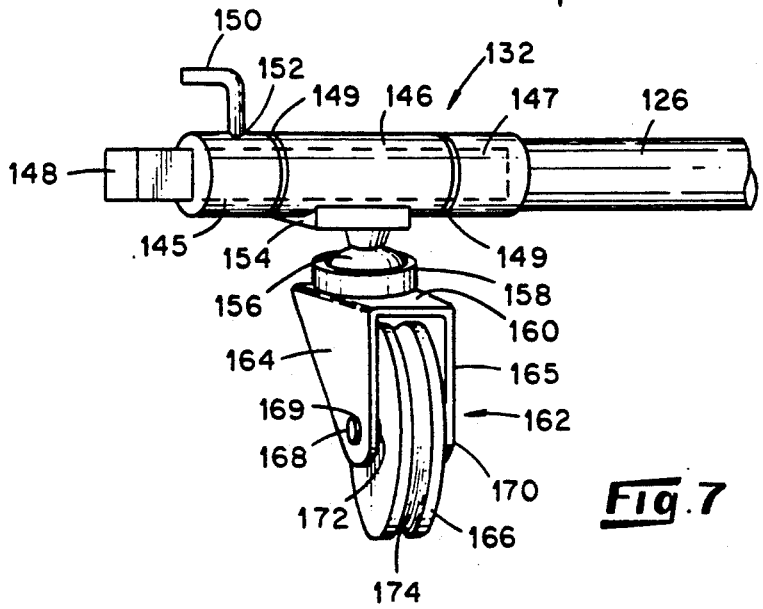
FIG. 7 is a close-up view of a ball joint pulley mounted on a rotating collar for use in the workstation of FIG. 6.

With reference now to FIG. 7, the ball joint pulley 130 and its associated collar 132 are shown mounted on the left-hand end of the rod 126. The collar 132 has an internal diameter dimensioned so that the collar is slidably positionable over a flat bar 148 welded to and extending outwardly from the left-hand end of the rod 126. The collar further includes a central sleeve 146 which is freely rotatable around the flat bar as by bearings 149 located between and connected to non-rotatable ends 145,147 of the collar.

A set screw 150 extends through an opening 152 in the end 145 of the collar for securing the collar to the flat bar 148. The central sleeve may be freely rotated between the ends 145, 147 about the flat bar 148 to position the pulley 130 either above the rod 126, as shown in FIG. 6, below the rod 126, as shown in FIG. 7, or at any point there between.

Alternatively, the flat bar and set screw may be omitted and the collar may be slidably positioned over the end of the rod and secured in place as by welds located at the ends 145, 147 of the collar, with sufficient clearance provided between the sleeve and the rod so as to render the sleeve freely rotatable.

The ball joint pulley 130 is shown in FIG. 7 in a downwardly depending orientation and includes base 154 attached as by welding to a central portion of the sleeve. A ball 156 extends downwardly from the base opposite the sleeve 146 and is engagingly received within a cylindrical housing 158 attached to a top plate 160 of a sheave housing 162. The sheave housing 162 includes a pair of spaced apart side plates 164,165 extending downwardly from opposite ends of the top plate 160. A sheave or pulley wheel 166 is rotatably secured between the side plates 164,165 by a pin 168 extending through aligned openings 169,170 in the side plates and an opening 172 extending through the central width of the sheave. A groove 174 is defined around the circumference of the pulley wheel for receiving the cable 142.

The ball joint pulley 134 and collar 136 are identical to the pulley 130 and collar 132, and are positioned on the right-hand end of the rod 126.

The above described embodiment is particularly suitable of performing exercises in which it is desired to exercise with both arms in a simultaneous manner, such as when performing lat pulls or curls. The ball joint pulleys 130, 134 expand the range of exercise motion available to the user in that the pulleys enable the cables 142 and 144 to be pulled out to the sides, up, down, to the front, or across one another.

For example, during exercise at workstation W2', the user pull the cables 142,144 in such a manner as to lower the bar 140, as shown in phantom, and exert a downward force on the cable 18'. Because the ball joint pulleys swivel in response to the force, this may be accomplished by exerting force on the handles 30' independent paths of direction. The cable 18' in turn exerts an upward force on the lifter 34' to lift the carrier and the weights in the same manner as described for cable 18 of workstation W2 of embodiment 10.

Figure 8:
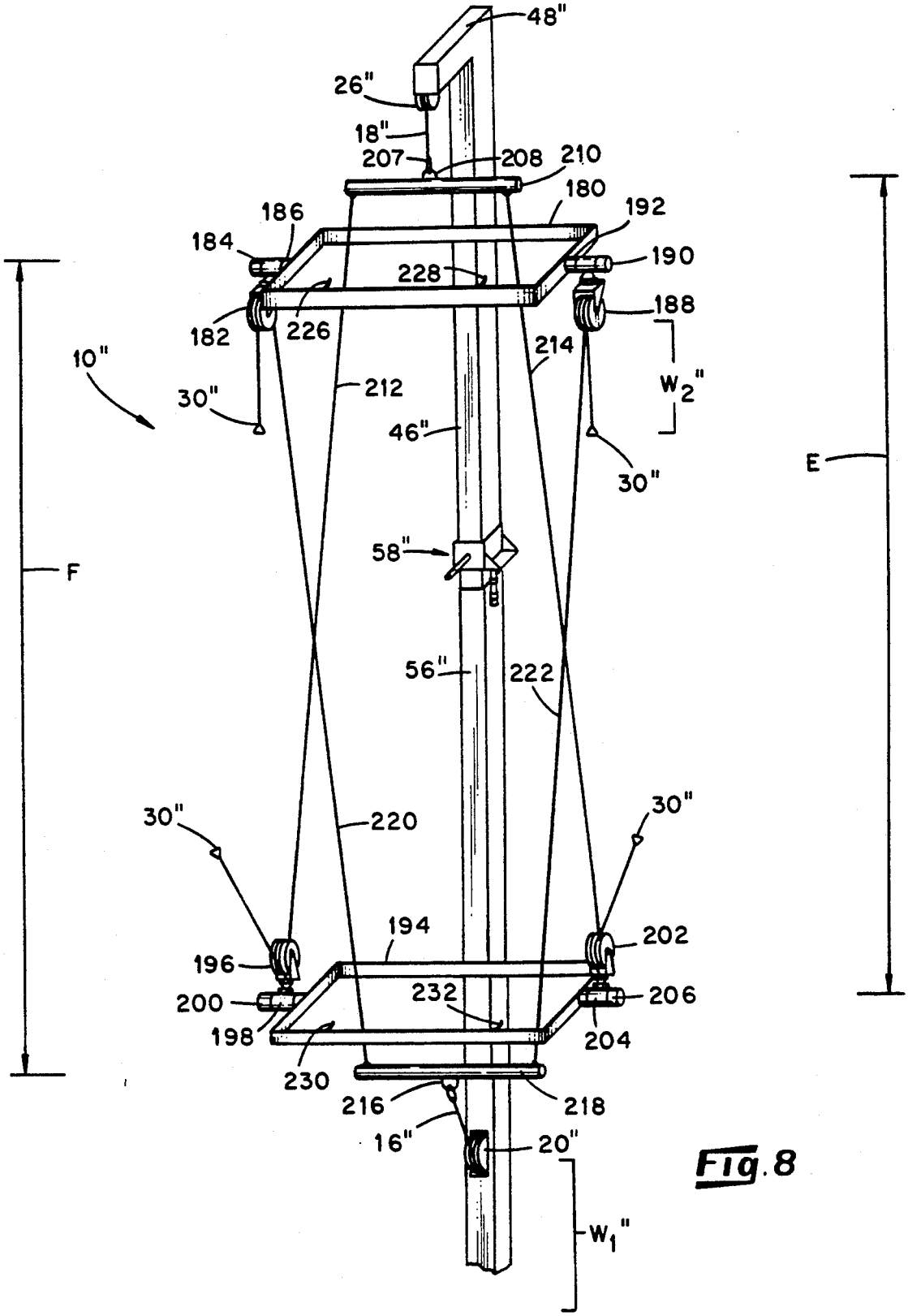
FIG. 8 is a fragmentary view of still another embodiment of the present invention in which both workstations have double cables and ball joint pulleys rotatably mounted on collars.

A further embodiment of the invention is illustrated in FIG. 8. This embodiment designated 10'' includes a double cable system for each workstation. This embodiment, like the embodiment 10', provides the user with an expanded range of motion and operates in the same manner as the embodiment 10', except that a double cable system is provided for each workstation. Elements corresponding to previously described elements will be referenced with the same characters using a double prime suffix.

The embodiment 10'' includes an upper rectangular bar 180 fixedly positioned, as by welding, to the frame member 46'' in the area of workstation W2'' so that the length of the bar 180 is perpendicular to the length of the frame member 46'' to define an opening lying in a horizontal plane. A ball joint pulley 182 rotatably mounted on a collar 184 is mounted on a rod 186 extending outwardly from the left-hand side of the rectangular bar parallel to the plane of the opening of the bar 180, and a ball joint pulley 188 rotatably mounted on a collar 190 is mounted on a rod 192 extending outwardly from the right-hand side of the rectangular bar preferably coaxially with the rod 186.

Likewise, a lower rectangular bar 194 is fixedly positioned to the frame member 56'' below the bar 180 in the area of workstation W1'' to define an opening lying in a horizontal plane. A ball joint pulley 196 rotatably mounted on a collar 198 is mounted on a rod 200 extending outwardly from the left-hand side of the rectangular bar parallel to the plane of the opening of the bar 194, and a ball joint pulley 202 rotatably mounted on a collar 204 is mounted on a rod 206 extending outwardly from the right-hand side of the rectangular bar coaxially with the rod 200. The ball joint pulleys 190, 202 and the collars 192, 204 are preferably identical in construction to the pulleys described in relation to embodiment 10'.

Figure 9:
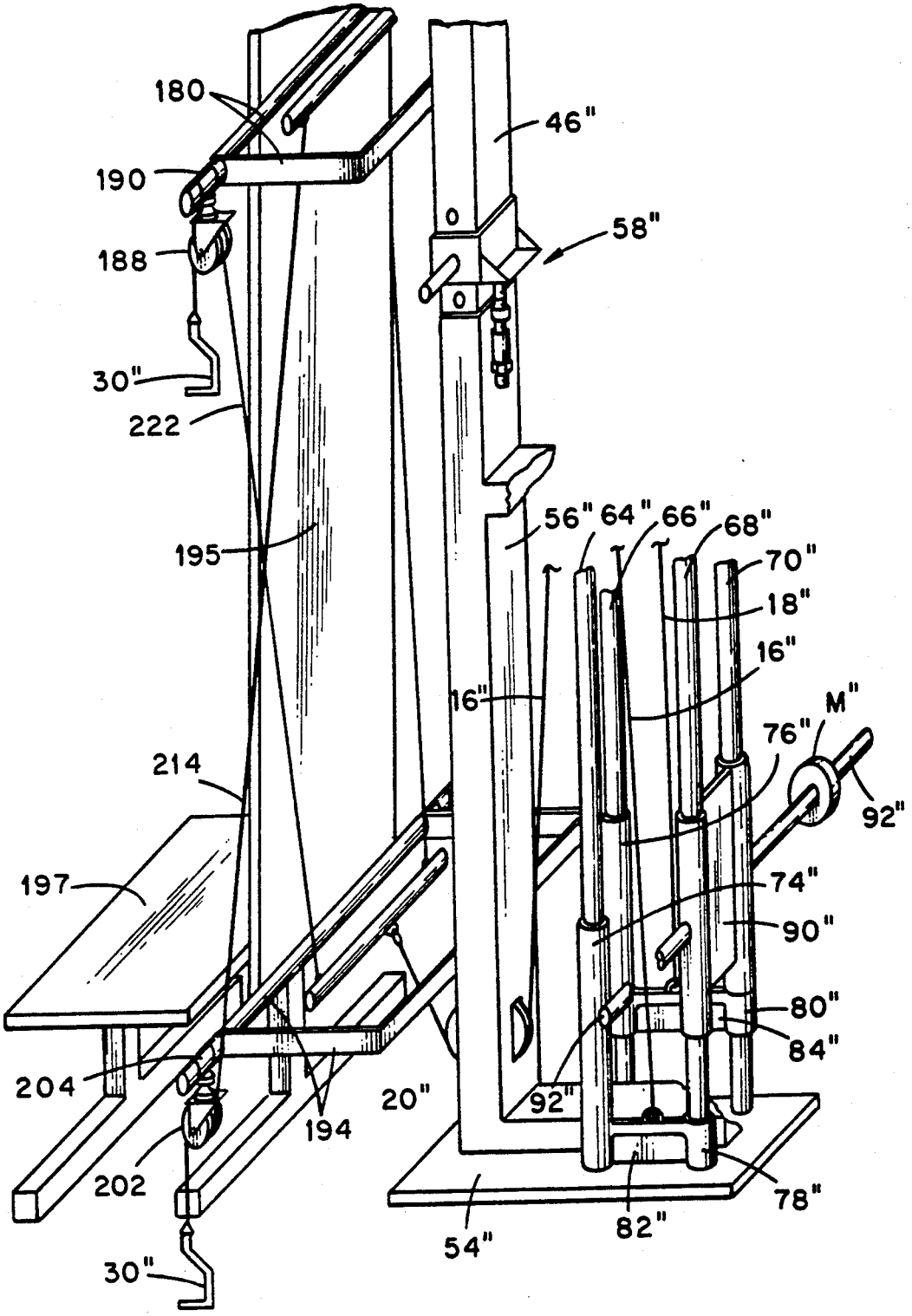
FIG. 9 is a fragmentary close-up view of the embodiment of FIG. 8 which shows the seat back installed.

As shown in FIG. 9, a seat back 195 or other support may be fixedly attached to the outwardly facing surfaces of the bars 180 and 194 as by welding or fasteners. During particular exercises, the user may be seated in a seat 197 which rests against the lowermost horizontal edge of the back 195, or standing such that the back of the user bears against the seat back 195.

With continued reference to FIG. 8, one end of the main cable 18'' of workstation W2'' attaches as by a clip 207 to a rigid metal loop 208 provided at the midpoint of a rod 210 so that at rest the rod 210 is supported by the cable 18'' just below the pulley 26''. A left-hand cable 212 attaches, such as by welding, to the left-hand end of the rod 210. Likewise, a right-hand cable 214 attaches to the right-hand end of the rod 210. Each cable 212,214 preferably has a length slightly greater than the vertical distance E between the raised position of the rod 210 and the bar 194 so that the handles do not bump against the pulleys, such as when released suddenly. The cables 196, 202 pass through the rectangular opening provided by the bar 180 and the lower end of each cable 212, 214 passes through the pulleys 196, 202, respectively, and attaches to a handle 30''.

In a manner similar to that previously described for cable 14''', the end of the main cable 16'' of workstation W1'' attaches to a depending rigid metal loop 216 located at the midpoint of a rod 218 so that at rest the rod 218 is positioned just above the pulley 20''. A cable 220 attaches at one end, such as by welding, to the left-hand end of the rod 218. Likewise, a cable 222 attaches at one end to the right-hand end of the rod 218. Each cable 220, 222 has a length greater than the distance F between the rod 218 and the rectangular bar 180. The cables 220, 222 passes through the pulleys 182 and 188, respectively, and the other end of each cable 220,222 attaches, as by welding or clamps, to a handle 30''.

The rectangular bar 180 includes a pair of hooks 226,228 attached to the inside surface opposite the side of the bar 180 which is attached to the frame member 46''. The rectangular bar 194 likewise includes a pair of hooks 230, 232 attached to the inside surface of the bar 194 opposite the side of the bar 194 which is attached to the frame member 56''. The hooks 226, 228 receive and support the rod 210 when workstation W1'' is not in use, and the hooks 230,232 receive and support the rod 218 when workstation W2'' is not in use.

This embodiment is also particularly suitable for two-handed exercises. For example, to exercise at workstation W1'' the user may first unhook the rod 210 from the cable 18'', as by unhooking the clip 207, and hang the rod 210 from the hooks 226 and 228. The user may then pull on the handles attached to cables 220, 222 to move the rod 218 upwardly and advance the cable 16'' over the pulley 20''. The cable 16'' in turn exerts an upward force on the lifter 32' to lift the carrier 40'' and the weights M'' in the same manner as described for cable 16 of workstation W1 of the embodiment 10.

It will therefore be appreciated that the present invention provides exercise apparatus which provides multiple work stations and multiple pulley/cable systems, yet only a single set of weights. By minimizing the number of weight sets, many advantages are achieved. Particularly, the present invention provides exercise apparatus of reduced weight, size, and cost as compared to conventional multiple work station type exercise machines.

In addition, exercise machines provided in accordance with the present invention are also more portable and are readily relocated and installed to other locations due to their reduced, size, weight, and ease of set up. There is also no complicated switching or cable mechanisms for manipulation in order to shift access to the weights from one work station to another. In fact, the user may alternate work stations at will.

Although several embodiments of the aforementioned have been described in the foregoing detailed description, it will be understood that the invention is capable of numerous rearrangements, modifications and substitutions without departing from the scope and spirit of the appended claims.

We claim:

1. An exercise machine which comprises a frame, resistance means connected to said frame including weight means resistably movable along a resistance path in response to application of a force thereto, first user-applied force means connected to said frame and positioned for enabling a user to engage and apply a first force to said resistance means by moving said first force means a desired distance along a first exercise path to provide resisted movement of said weight means along said resistance path for a distance which corresponds substantially to the distance that the first force means is moved along the first exercise path, second user-applied force means connected to said frame for enabling a user to engage and apply a second force to said resistance means by moving said second force means along a second exercise path to provide resisted movement of said weight means along said resistance path for a distance which corresponds substantially to the distance that the second force means is moved along the second exercise path, wherein said first and second user-applied force means are independently selectably engageable with said resistance means so that either may be employed by the user to engage and apply a force to move said weight means along said resistance path with the other of said first or second user-applied force means remaining substantially at rest and disengaged from said resistance means.

2. The exercise machine of claim 1, wherein said weight means of said resistance comprises a weight supported on guide means provided on said frame for movement along said resistance path between first and second positions and said first and second user-applied force means comprise lifters supported on said guide means on said frame and liftably engageable with said weight to provide the aforesaid movement, and wherein said lifters are disposed below said weight so that a selected one of said lifters may be employed to liftably engage and move said weight while the remainder of said lifters remain disengaged therefrom.

3. The machine of claim 1, wherein said resistance means comprises a weight supported on guide means on said frame for generally vertical movement along said resistance path between first and second positions and wherein said first and second user-applied force means each comprises a lifter supported on said guide means beneath said weight for supportably engaging said resistance weight in a manner so as to lift and move said weight along said path between said first and second positions, a cable connecting said lifter to handle means for gripping by a user and pulley means connected to said frame guidably supporting said cable between said handle means and lifter so that a user may grip a selected one of said handles and selectively apply said forces to said weight through said lifter.

4. The machine of claim 1, wherein said resistance means comprises generally vertically arranged guide means on said frame, said weight means comprises weights guidably supported on said guide means for vertical movement between lowered and raised positions, said first and second user-applied force means each comprises a lifter supported on said guide means under said weights for supportably engaging said weights to move said weights between positions on said guide means, a handle, a cable connecting said handle to said lifter, and pulley means guidably supporting said cable between said handle and lifter for movement in response to a force applied to said handle by the user to cause exertion of a vertically directed force on said weights through said lifter and said first and second user-applied force means configured such that upon application of a force to a selected one of said handles to cause its associated lifter to engage and move said weight from its lowered position, the remaining handle, cable and associated lifter remains substantially at rest.

5. The exercise machine of claim 1, wherein each of said first and second user-applied force means comprises a lifter disposed under said weight means for supportably engaging said weight means to move said weight means between positions along said resistance path, a handle, a cable connecting said handle to said lifter and pulley means guidably supporting said cable between said handle and said lifter the weight distribution and configuration of said handle, cable and lifter being such that they remain substantially at rest when said lifter is disengaged from said weight means.

6. An exercise apparatus, comprising:

means for providing a resistance mounted for movement along a support;

a plurality of lifters mounted adjacent said support for movement independent of one another along guide means provided on said support;

each of said lifters including means for liftably engaging said resistance to move said resistance independently of each of the other of said lifters such that each lifter may be employed independently of the others to urge said resistance along said support; and a plurality of force application means for use by a user to apply a user-applied force to said lifters to move said lifters along said guide means, each one of said force application means having a free end for being acted on by the user to move one of the force application means a desired distance along an exercise path and a terminal end located opposite the free end and connected to one of said lifters so that movement of each free end along one of the exercise paths causes one of the lifters and the resistance to be moved a distance which is substantially equal to the distance which the free end of the force application means is moved along the exercise path by the user during exercise.

7. The apparatus of claim 6, further comprising a plurality of primary cables, each one of said primary cables operatively associated with and directly connected to one of said lifters for urging said lifters along said guide means.

8. The apparatus of claim 7, further comprising means for connecting at least one of said primary cables to at least two alternate cables so that movement of said alternate cables results in movement of said one of said cables.

9. The apparatus of claim 8, further comprising means for guiding said alternate cables in a plurality of directions.

10. An exercise apparatus, comprising:

support means extending upwardly from a base;

means supporting a weight, said weight support means configured to support said weight for movement along a first path on said support means;

first guide means extending upwardly from said base adjacent said weight support means for guidably supporting a first lifter for movement thereon along a second path generally parallel to said first path, said first lifter including means for liftably engaging said weight to lift and move said weight along said first path in response to application of a force to cause movement of said first lifter along said second path;

second guide means extending upwardly from said base adjacent said weight support means for guidably supporting a second lifter for movement thereon along a third path generally parallel to said first path, said second lifter including means for liftably engaging said weight to lift and move said weight along said first path in response to application of a force to cause movement of said second lifter along said third path; and first and second force application means for use by a user to apply a user-applied force to said first and second lifters to move said first and second lifters along said guide means, each one of said force application means having a free end for being acted on by the user to move one of the force application means a desired distance along an exercise path and a terminal end located opposite the free end and connected to one of said lifters so that movement of each free end along one of the exercise paths causes one of the lifters and the resistance to be moved a distance which is substantially equal to the distance which the free end of the force application means is moved along the exercise path by the user during exercise.

11. An exercise machine comprising:

a first frame assembly for supporting the exercise machine above a floor surface;

resistance means for providing a resistance mounted for movement along a support connected to said first frame assembly;

a plurality of lifters mounted for movement independent of one another along guide means positioned adjacent said support;

a plurality of cables, each one of said cables having a free end for grasping by a user to move the cable a desired distance along an exercise path and a terminal end connected to one of said lifters;

each of said lifters including means for engaging said resistance means to enable application of a force to said resistance through said lifter to cause said lifter and resistance to move along said support independently of the other lifters for a distance corresponding substantially to the distance that the free end of the cable is moved along the exercise path;

a second frame assembly connected to said first frame assembly for supporting the apparatus adjacent an overlying surface; and means for adjusting said second frame assembly relative to said first frame assembly to cause the apparatus to be engaged between the floor and overlying surfaces.

12. An exercise apparatus, comprising:

a weight carrier mounted for movement along a support;

first and second lifters mounted adjacent said support for movement independent of one another along guides positioned adjacent to said support;

each of said lifters defining an extension positioned for movement along said support for liftably engaging said weight carrier;

a first cable system having a first end for being acted on by a user to move the first end a desired distance along a first exercise path and an opposite end connected to said first lifter for use by a user to move said first lifter along said support a distance corresponding substantially to the distance that the first end is moved along the first exercise path to lift said weight carrier a distance corresponding substantially to the distance that the first end is moved along the first exercise path; and a second cable system having a first end for being acted on by a user to move the first end a desired distance along a second exercise path and an opposite end connected to said second lifter for use by the user to move said second lifter along said support a distance corresponding substantially to the distance that the first end is moved along the second exercise path to lift said weight carrier a distance corresponding substantially to the distance that the first end is moved along the second exercise path, said second cable system comprising a primary cable connected to said second lifter, and means for connecting the primary cable to at least two alternate cables so that movement of the alternate cables results in movement of the primary cable, said second lifter, and said weight carrier.

13. The exercise machine of claim 11, wherein said plurality of lifters comprises two lifters.

* * * * *